US006857157B1

(12) United States Patent
Hoyle

(10) Patent No.: US 6,857,157 B1
(45) Date of Patent: Feb. 22, 2005

(54) ALL-IN-ONE FITTING BRUSH

(76) Inventor: Fred C. Hoyle, 3106 W. Mcneil St., Laaveen, AZ (US) 85339

( * ) Notice: Subject to any disclaimer, the term of this patent is extended or adjusted under 35 U.S.C. 154(b) by 0 days.

(21) Appl. No.: 10/057,805

(22) Filed: Jan. 23, 2002

Related U.S. Application Data

(60) Provisional application No. 60/263,584, filed on Jan. 22, 2001.

(51) Int. Cl.[7] ..... B08B 9/00

(52) U.S. Cl. ..... 15/104.05; 15/104.165; 15/104.2; 15/164; 15/211

(58) Field of Search ..... 15/65, 104.03, 15/104.05, 104.095, 104.16, 104.165, 104.2, 164, 211

(56) References Cited

U.S. PATENT DOCUMENTS 2,383,464 A * 8/1945 Brown ..... 15/104.03
2,629,121 A * 2/1953 Petre ..... 15/104.03
5,513,410 A * 5/1996 Liu ..... 15/164
5,621,941 A * 4/1997 Liu ..... 15/164
5,709,003 A * 1/1998 Batch ..... 15/164

FOREIGN PATENT DOCUMENTS

FR 1045017 * 6/1953 ..... 15/164
GB 352274 * 7/1993 ..... 15/104.05

* cited by examiner

*Primary Examiner*—Mark Spisich
(74) *Attorney, Agent, or Firm*—Lewis and Roca LLP; Lucius L. Lockwood

(57) ABSTRACT

An all-in-one fitting brush system that is adapted for use in cleaning the ends of pipes and pipe fittings so that proper joints may be made between the pipes and the fittings. The all-in-one fitting brush system includes a handle, a dog leg shaped shank, and a number of detachable brushes and a cleaning element holding shaft.

1 Claim, 1 Drawing Sheet

ALL-IN-ONE FITTING BRUSH

This application claims benefit of U.S. provisional No. 60/263,584, filed Jan. 22, 2001.

TECHNICAL FIELD

The present invention relates to brushes for cleaning pipe ends, pipe fitting and the like and more particularly to a multi-headed cleaning tool that includes a handle having a rotatable end fitting for receiving a dog legged shaped shank, a dog leg shaped shank having a far end provided with a stop ball with an outside band for receiving the back end of the shaft of a cleaning item, and a number of cleaning items including detachable brushes and shafts adapted for holding sandpaper and the like.

BACKGROUND OF INVENTION

It is often difficult for plumbers and other individuals who work with piping tubing and the like to clean the interior of the fitting prior to making attachments. Although it is difficult to perform these cleanings, it is necessary that they be cleaned so that a proper joint may be fastened between the pipe and the fitting. It would be desireable, therefore, to have a tool that included a handle that could be easily attached to any one of a number of brushes or other cleaning elements so that the user could rapidly and easily clean the pipe and/or fitting as needed.

SUMMARY OF INVENTION

It is thus an object of the invention to provide an all-in-one fitting brush that includes a handle having a rotatable end fitting for receiving a dog legged shaped shank, a dog leg shaped shank having a far end provided with a stop ball with an outside band for receiving the back end of the shaft of a cleaning item, and a number of cleaning items including detachable brushes and shafts adapted for holding sandpaper and the like.

Accordingly, an all-in-one fitting brush is provided. The all-in-one fitting brush includes a handle having a rotatable end fitting for receiving a dog legged shaped shank, a dog leg shaped shank having a far end provided with a stop ball with an outside band for receiving the back end of the shaft of a cleaning item, and a number of cleaning items including detachable brushes and shafts adapted for holding sandpaper and the like.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
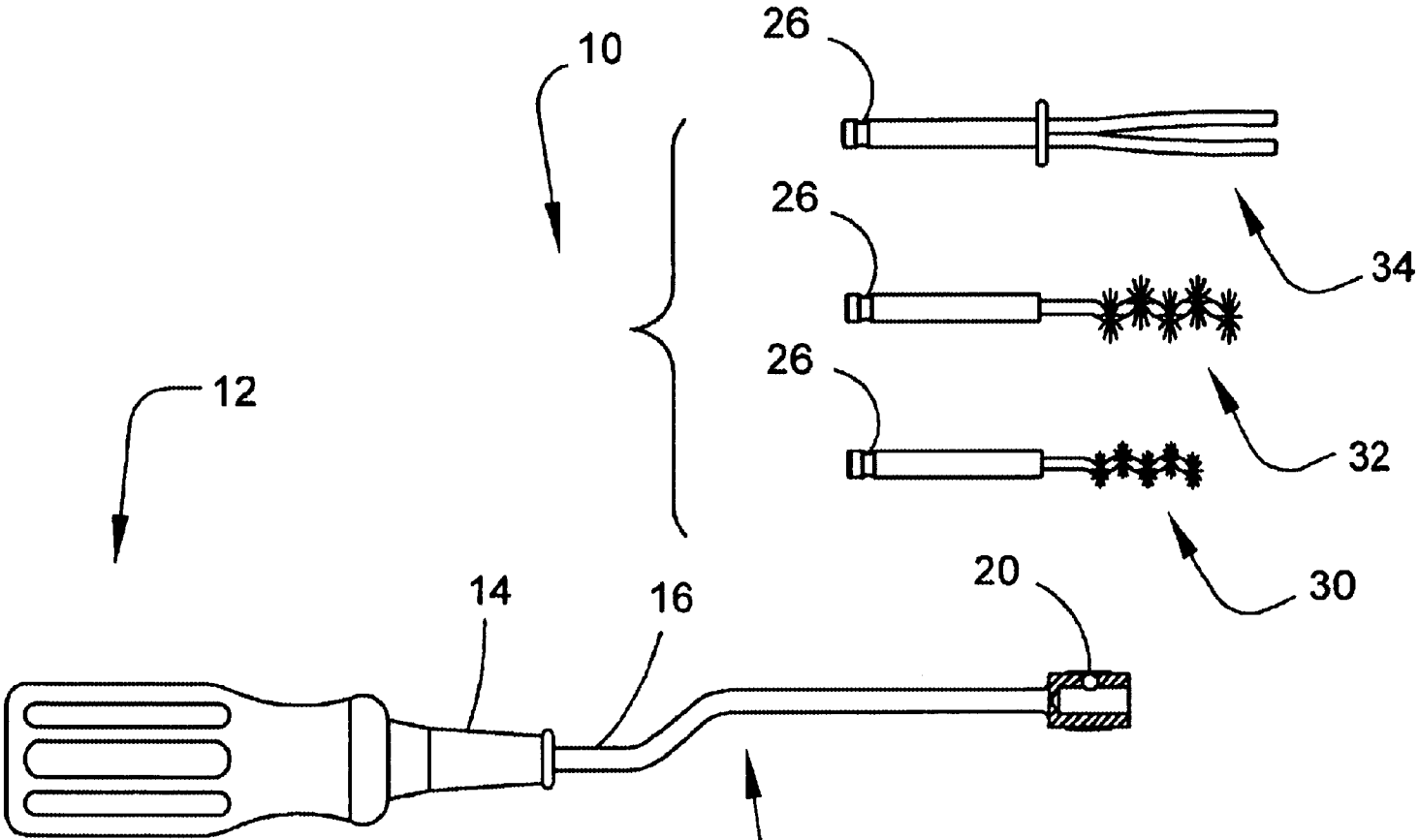
FIG. 1 is a side plan view of an exemplary embodiment of the fitting brush system of the present invention showing the handle, the dog leg shaped shank, two exemplary detachable brushes and an exemplary shaft having a slot for gripping sandpaper at the far end thereof.

FIG. 1 shows an exemplary embodiment of the all-in-one fitting brush of the present invention generally designated 10. All-in-one fitting brush 10 includes a handle generally designated 12 having a rotatable end fitting 14 that is adapted for receiving the end 16 of a dog leg shaped shank generally designated 18. Dog leg shaped shank 18 has a far end 20 that is adapted to receive the shaft portion 26 of a variety of cleaning tools including brushes 30, 32 and sandpaper holding tool 34.

It can be seen from the preceding description that an all-in-one fitting brush has been provided.

It is noted that the embodiment of the all-in-one fitting brush described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An all-in-one fitting brush comprising:

handle having a rotatable end fitting;

a shank having first and second ends, the shank further comprising first and second end portions which are generally parallel to one another and which are connected by a middle offset portion, the first end of the shank being coupled to the rotatable end fitting thereof such that the shank is rotatable with respect to the handle, the second end of the shank including a socket portion adapted to receive a shaft of a cleaning item; and a plurality of cleaning items, each of the cleaning items including a shaft adapted to be detachably received in the socket portion of the shank, the plurality of cleaning items including:

a first brush;

a second brush;

a cleaning item adapted to hold a sheet such as sandpaper.

* * * * *

UNITED STATES PATENT AND TRADEMARK OFFICE

CERTIFICATE OF CORRECTION

PATENT NO. : 6,857,157 B1
DATED : February 22, 2005
INVENTOR(S) : Fred C. Hoyle, IV It is certified that error appears in the above-identified patent and that said Letters Patent is hereby corrected as shown below:

Title page,
Item [75], Inventors, should read -- Fred C. Hoyle, IV --

Column 1,
Line 9, the third word should read -- fittings --
Line 21, the second word should read -- fittings --

Column 2,
Line 49, should read -- a second brush; and --

Signed and Sealed this

Thirty-first Day of May, 2005

JON W. DUDAS
*Director of the United States Patent and Trademark Office*